US006014939A

United States Patent [19]

Gusmeri et al.

[11] Patent Number: 6,014,939

[45] Date of Patent: Jan. 18, 2000

[54] UNIVERSALLY STABLE OIL WELL SHIP TURRET

[75] Inventors: Val J. Gusmeri; John Moses, both of Houston, Tex.; Roger Burnison, Berkshire, United Kingdom

[73] Assignee: Hydralift, Inc., Houston, Tex.

[21] Appl. No.: 08/938,344

[22] Filed: Sep. 26, 1997

Related U.S. Application Data

[63] Continuation-in-part of application No. 08/790,926, Jan. 29, 1997, abandoned.

[51] Int. Cl.[7] ..... B63B 21/00

[52] U.S. Cl. ..... 114/230.12

[58] Field of Search ..... 114/230.12, 293; 166/334, 353

[56] References Cited

U.S. PATENT DOCUMENTS

| | | | |
|---|---|---|---|
| 4,753,553 | 6/1988 | Carlsen et al. | 405/195 |
| 4,943,188 | 7/1990 | Peppel | 405/224 |
| 5,025,742 | 6/1991 | Urdshals | 114/230 |
| 5,181,799 | 1/1993 | Carruba | 405/195.1 |
| 5,339,760 | 8/1994 | Korsgaard | 114/230 |
| 5,762,017 | 6/1998 | Groves | 114/230.12 |
| 5,839,387 | 11/1998 | Myklebust | 114/230.12 |

FOREIGN PATENT DOCUMENTS 61-155086 12/1984 Japan .

*Primary Examiner*—Ed Swinehart
*Attorney, Agent, or Firm*—Derek R. Van Gilder

[57] ABSTRACT

A universally stable oil-well-ship turret (1) has a circumturret cylinder (2) with an inside periphery sufficiently greater than an outside periphery of a turret cylinder (7) to allow vertical positioning of the turret cylinder within the circumturret cylinder in opposition to variations from verticality of the circumturret cylinder in response to effects of wave and weather conditions on a marine vessel in which the circumturret cylinder is positioned rigidly. A plurality of horizontal and vertical bearings (10, 11) are pressure-cylinder actuated to maintain horizontal attitude of a turret flange (8) from which the turret cylinder is extended downward vertically into the circumturret cylinder. Sensor-responsive automation that is self-checking for reliability, selective manual operation and computer controls (52, 54) are provided. Appropriate redundancy and backup are provided for all systems, components and features. A use method is described.

44 Claims, 9 Drawing Sheets

59
66
60
55
16
23
JUNCTION BOX
14
67
61
AFT
FWD
64
65
55
55
63
62
JUNCTION BOX
JUNCTION BOX
68
57
58
JUNCTION BOX
55
56
56
56
56
ZENER BARRIER
ZENER BARRIER
ZENER BARRIER
ZENER BARRIER
69
69
TURRET POSITION CONTROLLER
52
54
PC COMPUTER DISPLAY ANALYSIS AND HOMOLOGATION

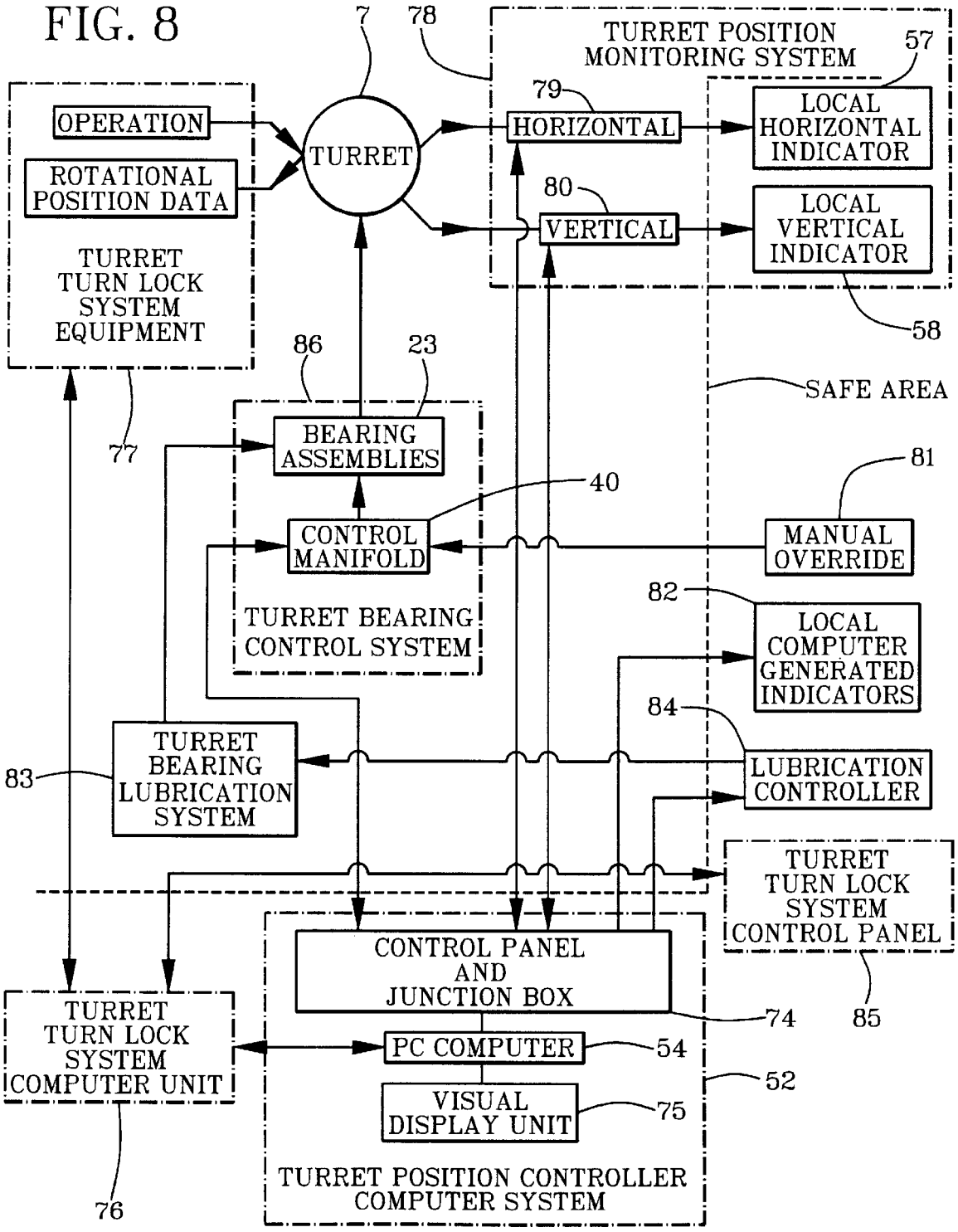
FIG. 8
7
78
TURRET POSITION MONITORING SYSTEM
57
79
HORIZONTAL
LOCAL HORIZONTAL INDICATOR
OPERATION
TURRET
ROTATIONAL POSITION DATA
80
VERTICAL
LOCAL VERTICAL INDICATOR
TURRET TURN LOCK SYSTEM EQUIPMENT
58
86
23
SAFE AREA
BEARING ASSEMBLIES
77
81
40
CONTROL MANIFOLD
MANUAL OVERRIDE
82
TURRET BEARING CONTROL SYSTEM
LOCAL COMPUTER GENERATED INDICATORS
84
TURRET BEARING LUBRICATION SYSTEM
83
LUBRICATION CONTROLLER
TURRET TURN LOCK SYSTEM CONTROL PANEL
CONTROL PANEL AND JUNCTION BOX
74
85
TURRET TURN LOCK SYSTEM COMPUTER UNIT
PC COMPUTER
54
52
VISUAL DISPLAY UNIT
75
TURRET POSITION CONTROLLER COMPUTER SYSTEM
76

UNIVERSALLY STABLE OIL WELL SHIP TURRET

This is a continuation-in-part of application Ser. No. 08/790,926 that was filed on Jan. 29, 1997 by Gusmeri, V. et al. with a title of "TURRET BEARING AND CONTROL SYSTEM", now abandoned.

BACKGROUND OF THE INVENTION

1. Field of the Invention

This invention relates to vertical, horizontal, rotational and structural stabilization of mooring turrets for suspension of mooring lines, marine risers and related oil-well lines and equipment from ships for petroleum drilling and production.

2. Relation to Prior Art

Ships structured for petroleum drilling and production in offshore and oceanic bodies of water are seabed-anchored from bottoms of various types of turret cylinders through which drilling and production activities are accomplished. Turret-cylinder changes of direction, position and verticality must be prevented to the fullest extent possible while the largest of ships toss, turn, change directions and change positions frequently as a result of ambient conditions.

Economical construction and physical weight of ship structure can not accommodate sufficiently rigid hulls to prevent resilient distortion of ship-deck turrets and turret bases for suspension of oil-well lines and mooring lines. Stabilization of mooring turrets related to petroleum-exploitation systems on necessarily resilient hulls is critical.

Examples of different but related mooring-turret systems are described in the following patent documents. U.S. Pat. No. 5,339,760, issued to Korsgaard, taught a submersible buoyant mooring element that raised buoyantly into sealing contact with a turret cylinder of a ship, but was silent about structure of the turret cylinder for supporting rotational change and radial displacement. U.S. Pat. No. 5,181,799, issued to Carruba, described a rigidly vertical tube attached to a seabed and supported triangularly at a platform-pivot point by support members that were attached to the seabed at separately distant positions for offshore petroleum activities. U.S. Pat. No. 5,025,742, issued to Urdshals, described a turret type of moor on a bow of a seagoing vessel such as an oil tanker without reference to a turret cylinder for petroleum-exploitation. U.S. Pat. No. 4,943,188, issued to Peppel, taught a rotative lug-anchor connector for releasable securement of a tether from a tension-leg platform to a seabed but did not describe working relationship to or structure of a turret cylinder for a marine vessel. Japanese Patent Number 61-155086, issued to Ishida, described a roller-supported turret with equal distribution of weight and rotative drive on a plurality of rollers that would require economically prohibitive weight and cost for vessel construction and for turret construction and operation. Finally, U.S. Pat. No. 4,753,553, issued to Carlsen et al, taught turret structure and turret-bearing structure which accommodated structurally resilient distortion of a marine hull and of a turret base, but not with universal stabilization as taught by this invention.

The Carlsen patent described a mooring turret having a turret-cylinder (skirt 13) axis with maximized concentricity to a cylinder wall 23 extending vertically through a hull 14. A plurality of axial or vertical bearing structures 30 in combination with a plurality of radial or horizontal bearing structures 46 were pressure actuated to compensate for resilient distortions of the hull 14 and of bearing races 25 and 37 that result from marine and weather effects on the hull 14 and on the races 25 and 37 respectively. This facilitated reduction of weight and size of the mooring turret or rig 11 having a platform 12 from which the skirt 13 was extended downward vertically through the cylinder wall 23 which had emergency bearing members 22, 22*a* and 22*b* in sliding contact with the cylinder wall 23. Concentricity of the skirt 13 with the cylinder wall 23 and parallelism of the platform 12 with a deck of the hull 14 created instead of solving yet a greater problem. It prevented universal stabilization. Instead, it caused the rig 11 to sway, tip, yaw, heave and turn with unstable positioning of the hull 14 in response to waves, water current and weather. In addition, bearing positioning and control were inadequate for minimizing weight and size of the turret. Further problems included interference of mooring lines, choke/kill lines and other equipment with risers in a moon pool.

SUMMARY OF THE INVENTION

In light of need for improvement of mooring turrets for petroleum-exploitation ships, objects of this invention are to provide a universally stable oil-well-ship turret which:

- Maintains verticality of rig equipment above and resulting verticality of a turret cylinder below a work deck in opposition to heaving, pitching and yawing of a marine vessel from wave and weather conditions;
- Provides accurate, immediate and complete positional compensation for resilient distortions of hulls, turret bases and turret-bearing races resulting from effects of wave and weather conditions;
- Prevents rotational twisting and turning of arrays of suspended risers and mooring lines from ship turning and rotation;
- Separates mooring lines, risers, well-operating lines, choke/kill lines, fire-protection equipment and other well-operating equipment;
- Maximizes reliability and safety redundancy of operational features;
- Minimizes weight and cost of mooring turrets;
- Provides convenience of automatic operation with selective manual operation; and
- Positions deck equipment, rig equipment and mooring equipment separately for non-interference, convenience and efficiency of operation.

This invention accomplishes these and other objectives with a universally stable oil-well-ship turret having a circumturret cylinder with an inside periphery sufficiently greater than an outside periphery of a turret cylinder to allow vertical positioning of the turret cylinder within the circumturret cylinder in opposition to variations from verticality of the circumturret cylinder in response to effects of wave and weather conditions on a marine vessel in which the circumturret cylinder is positioned rigidly. A plurality of horizontal and vertical bearings are pressure-cylinder actuated to maintain horizontal attitude of a turret flange from which the turret cylinder is extended downward vertically into the circumturret cylinder. Sensor-responsive automation that is self-checking for reliability, selective manual operation and computer controls are provided. Appropriate redundancy and backup are provided for all systems, components and features.

BRIEF DESCRIPTION OF DRAWINGS

This invention is described by appended claims in relation to description of a preferred embodiment with reference to the following drawings which are referred to as FIGS. in this document and described briefly as follows:

FIG. 8 is a block diagram of an electro-hydraulic control system;

DESCRIPTION OF PREFERRED EMBODIMENT

Figure 1:
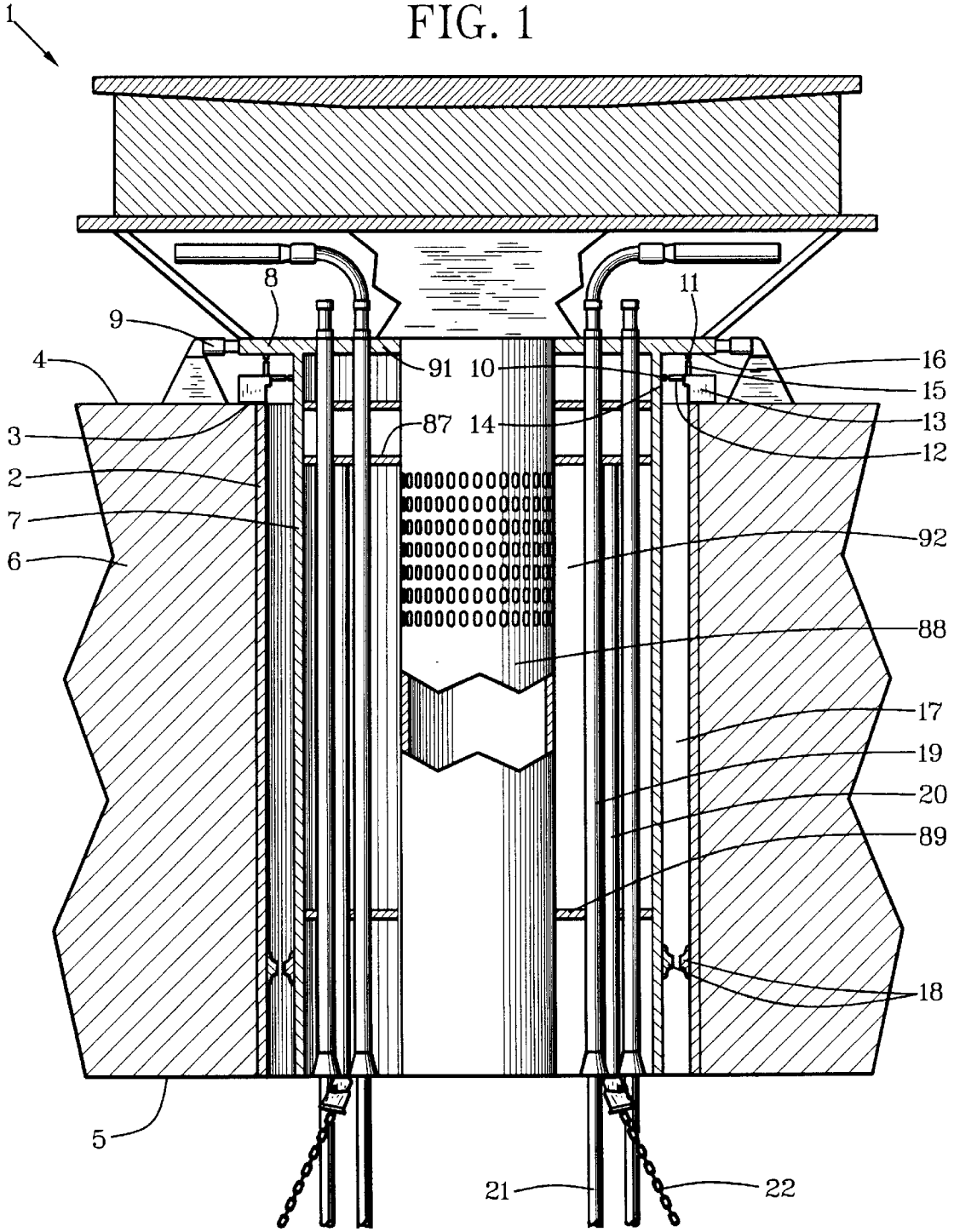
FIG. 1 is a partially cutaway side view of a universally stable mooring turret in a well-working portion of an oil-well ship.

Reference is made first to FIG. 1. A universally stable mooring turret 1 has a circumturret cylinder 2 extended vertically downward from a turret base 3 proximate a main deck 4 to a bottom 5 of a well-working portion of an oil-well ship 6. A turret cylinder 7 is extended rotationally downward inside of the circumturret cylinder 2 and has a turret flange 8 extended radially outward above the turret base 3. A turret rotator 9 in rotative communication between the circumturret cylinder 2 and the turret cylinder 7 is employed to prevent the turret cylinder 7 from changing direction by rotating the turret cylinder 7 in compensative opposite directions to directional changes of the oil-well ship 6 resulting from effects of ambient conditions and ship thrust on the oil-well ship 6.

The turret cylinder 7 rotates on a designedly universal bearing system which allows attitudinal change and rotational change in a plurality of directions that in combination are a universal bearing system within design limits. A preferred universal bearing system described in this document is a combination of a plurality of horizontal bearings 10 and a plurality of vertical bearings 11.

The plurality of horizontal bearings 10 are extended horizontally from horizontal-bearing pressure cylinders 12 that are attached to bearing bases 13 which are affixed circumferentially to the oil-well ship 6 about an outside periphery of the turret base 3. A horizontal-bearing race 14 against which the horizontal bearings 10 bear controllably is oriented vertically on an outside circumferential portion of the turret cylinder 7.

The plurality of vertical bearings 11 are extended vertically from vertical-bearing pressure cylinders 15 that are attached to the bearing bases 13 that are affixed circumferentially to the oil-well ship 6 about an outside periphery of the turret base 3. A vertical-bearing race 16 against which the vertical bearings 11 bear controllably is oriented horizontally on a circumferential portion of a bottom of the turret flange 8.

An outside circumferential periphery of the turret cylinder 7 is sufficiently smaller than an inside periphery of the circumturret cylinder 2 to allow universal tilting of the circumturret cylinder 2 from affects of ambient conditions on the oil-well ship 6 while the turret cylinder 7 is maintained selectively vertical within cylindrical inside boundaries of the circumturret cylinder 2. Verticality of the turret cylinder 7 is achieved by variation of length of extension of vertical bearings 11 from vertical-bearing pressure cylinders 15 to raise particular portions and to lower other portions of the vertical-bearing race 16 on the turret flange 8 circumferentially for universally stable verticality of the mooring turret 1.

The horizontal bearings 10 have a plurality of functions in universally stabilizing the universally stable mooring turret 1. Included are (a) positioning the turret cylinder 7 laterally for compensative attitudinal tilt, (b) compensating for laterally structural distortion of the horizontal-bearing race 14 and of the turret base 3, (c) pivoting of bearing plates on the horizontal bearings 10 while the horizontal-bearing pressure cylinders 12 remain rigidly horizontal, and (d) imparting selective frictional pressure against the horizontal-bearing race 14 to provide a brake effect for restricting objectionable rotation of the turret cylinder 7.

The vertical bearings 11 also have a plurality of functions in universally stabilizing the universally stable mooring turret 1. Included are (a) raising and lowering particular portions of the turret flange 8 for select verticality of the turret cylinder 7, (b) compensating for vertically structural distortion of the vertical-bearing race 16 and of the turret base 3 and (c) pivoting of bearing plates on the vertical bearings 11 while the vertical-bearing pressure cylinders 15 remain rigidly vertical.

Verticality differences between the circumturret cylinder 2 and the turret cylinder 7 are contained within an annular-clearance space 17 intermediate the outside periphery of the turret cylinder 7 and the inside periphery of the circumturret cylinder 2. Lower support fenders 18 which preferably are resilient can be provided in a bottom portion of the annular-clearance space 17.

A plurality of riser tubes 19 and a plurality of chain pipes 20 are positioned linearly within the inside periphery of the turret cylinder 7. Marine risers 21 are extended from bottom ends of the riser tubes 19 and anchor chains 22 are extended from bottom ends of the chain pipes 20. The marine risers 21 are attached to oil-well templates, not described in this document, on seabeds and the anchor chains 22 are attached to anchors, not described in this document, on the seabeds.

The marine risers 21 and the anchor chains 22 are arrayed in different directions over a wide area of seabed. Rotation of the turret cylinder 7 would rupture connection of the marine risers 21 and the anchor chains 22 to the oil-well ship 6 and cannot be tolerated. Minimizing deviation of directional change and lateral displacement of anchor and riser mooring increases operational span and efficiency. Hence, a necessity for a universally stable mooring turret 1.

Weight and cost of an oil-well ship 6 and a mooring turret without resilient distortion from effects of ambient conditions are prohibitive with known materials that are economically feasible. Consequently, oil-well ships 6 and mooring turrets such as the universally stable mooring turret 1 are designed for adaptation to resiliently distortional structure with minimal weight and cost per size and productivity.

Figure 2:
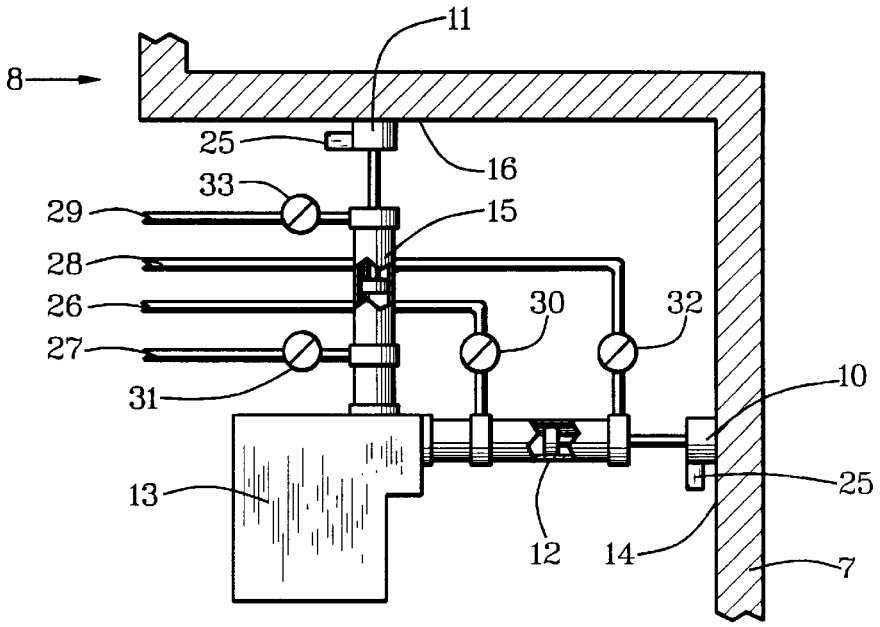
FIG. 2 is a partially cutaway side view of a bearing assembly having one horizontal bearing and two vertical bearings.
Figure 3:
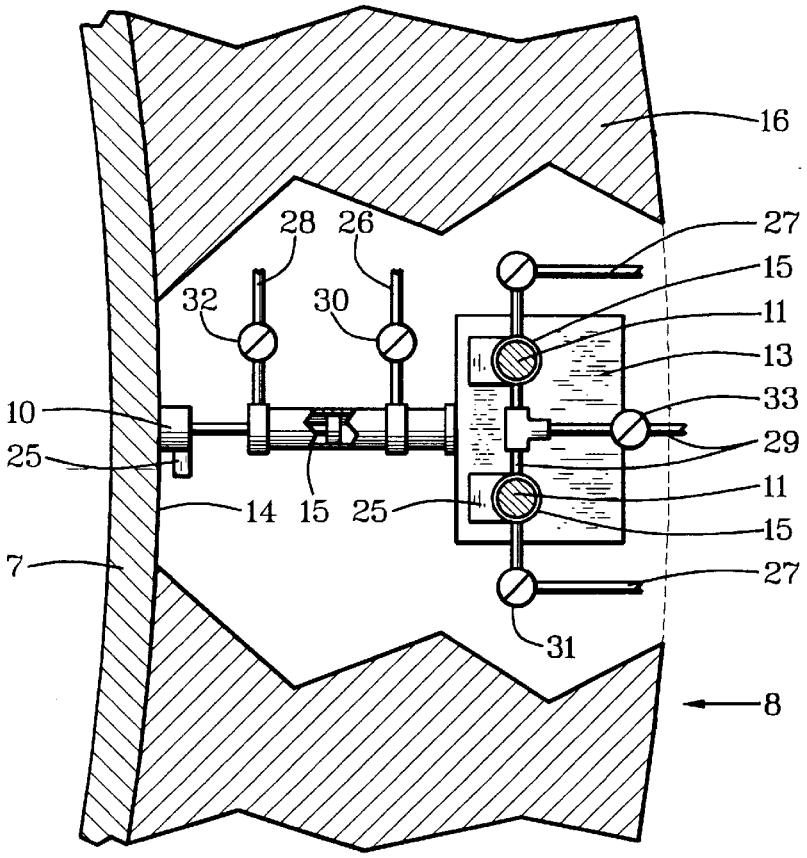
FIG. 3 is a partially cutaway top view of the FIG. 2 illustration.
Figure 4:
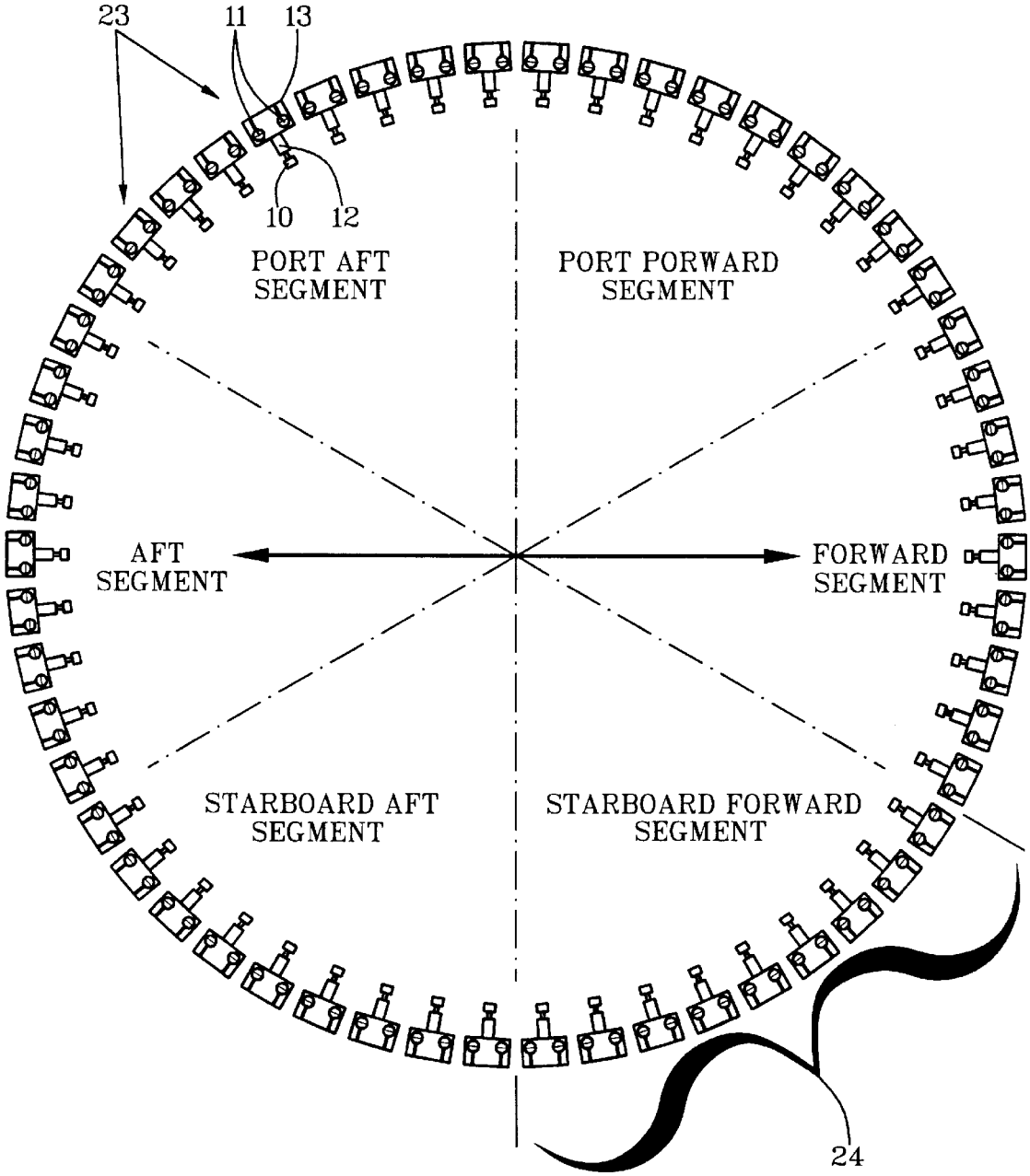
FIG. 4 is a top view of a circumferential arrangement of fifty-four bearing assemblies.

Reference is made now to FIGS. 2–4 in addition to referring further to FIG. 1. The horizontal bearings 10 and the vertical bearings 11 for this preferred universal bearing system can be assembled in bearing assemblies 23 with two vertical bearings 11 and one horizontal bearing 10 in each bearing assembly 23 on the bearing bases 13. Bearing assemblies 23 are positioned circumferentially about the turret base 3. A preferred plurality of bearing assemblies 23 is fifty-four. For the fifty-four bearing assemblies 23, there are one-hundred-and-eight vertical bearings 11 and fifty-four horizontal bearings 10. The plurality of fifty-four bearing assemblies 23 can be grouped into bearing-assembly segments 24 which are positioned circumferentially about the turret base 3 and which are controllable arcuately. Each bearing-assembly segment 24 has nine bearing assemblies 23 in directional sections for referencing control directions.

The horizontal bearings 10 and the vertical bearings 11 have frictional surfaces in sliding contact with the horizontal-bearing race 14 and the vertical-bearing race 16 respectively. To assure adequate and reliable viscosity, the horizontal bearings 10 and the vertical bearings 11 have bearing lubricators 25 that are controllable remotely and automatically.

The horizontal bearings 10 and support components have size, shape, bearing capacity and plurality to position the turret cylinder 7 horizontally in compensating opposition to horizontal displacement of the circumturret cylinder 2 from horizontal displacement of the oil-well ship 6. Similarly and cooperatively, the vertical bearings 11 and support components have size, shape, bearing capacity and plurality to orient the turret cylinder 7 vertically in compensating opposition to vertical and attitudinal displacement of the circumturret cylinder 2 from vertical and attitudinal displacement of the oil-well ship 6. Also, however, weights of the horizontal bearings 10 and the vertical bearings 11 with their support components are minimized within their respective capacities.

Horizontal-bearing hydraulic-input lines 26 and vertical-bearing hydraulic-input lines 27 from a plurality of hydraulic-pressure sources are provided for duplicative reliability. Return horizontal-bearing lines 28, return vertical-bearing lines 29, horizontal-bearing input valves 30, vertical-bearing input valves 31, horizontal-bearing return valves 32 and vertical-bearing return valves 33 are provided in accordance with particular hydraulic systems as described below.

Figure 5:
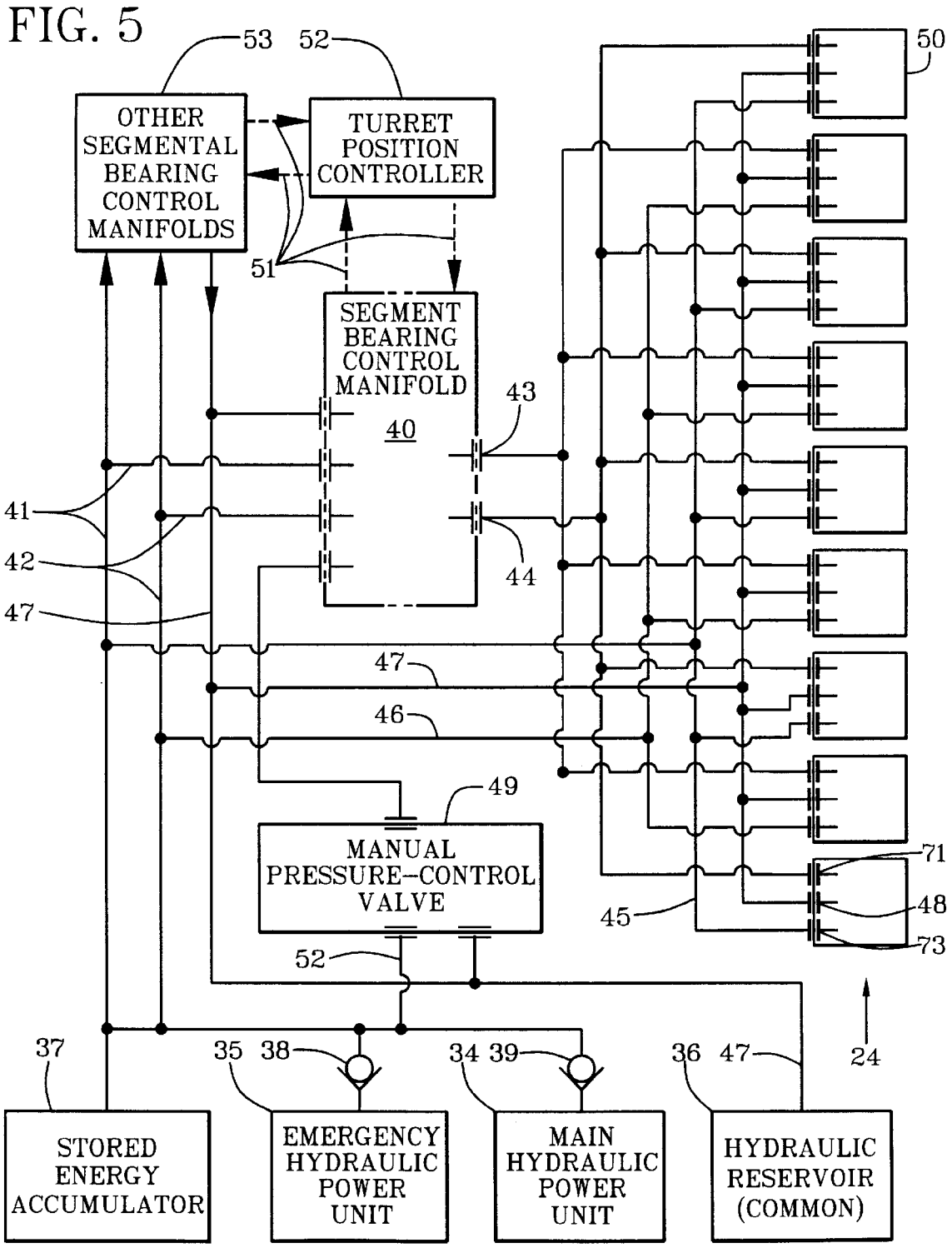
FIG. 5 is a block diagram of a hydraulic system for one segment of nine bearing assemblies.

Referring to FIG. 5 and referring further to FIGS. 1–4 also, hydraulic-pressure sources can include a main hydraulic power unit 34, an emergency hydraulic power unit 35, a hydraulic reservoir 36 and stored-energy accumulator 37. Lines representing hydraulic pressure lines lead as indicated to and from bearing assemblies 23 in a select bearing-assembly segment 24. The hydraulic reservoir 36 is common to the main hydraulic power unit 34 and to the emergency hydraulic power unit 35. The bearing-assembly segment 24 is representative of either a port-aft segment, a port-forward segment, a forward segment, a starboard-forward segment, a starboard-aft segment or an aft segment as depicted clockwise circumferentially in FIG. 4.

Hydraulic power is directed from the main hydraulic power unit 34 and the emergency hydraulic power unit 35 which are identical in capacity. The emergency hydraulic power unit 35 provides backup hydraulic power in event of failure of the main hydraulic power unit 34, but can be used interchangeably with the main hydraulic power unit 34 to test working condition and to equalize wear as appropriate. The stored-energy accumulator 37 provides stored hydraulic pressure as an additional level of reliability redundancy in event of failure of the emergency hydraulic power unit 35 after failure of the main hydraulic power unit 34.

Pressure lines from the main hydraulic power unit 34 and the emergency hydraulic power unit 35 have a first check valve 38 and a second check valve 39 to prevent reverse flow into the emergency hydraulic power unit 35 or into the main hydraulic power unit 34.

A bearing-control manifold 40 receives hydraulic power from a first hydraulic line 41 and a second hydraulic line 42. The bearing-control manifold 40 provides hydraulic power to a select bearing-assembly segment 24 from a first discharge port 43 and a second discharge port 44. Hydraulic power is distributed through branched hydraulic-power lines 45 in a manner that each branched hydraulic-power line 45 supplies hydraulic power to a portion of the bearing assemblies 23 through a hydraulic-power line 45 and a distribution line 46.

Return lines 47 from return valves 48 to the hydraulic reservoir 36 have common conveyance communication without necessity of plurality.

A manual pressure-control valve 49 allows manual actuation of bearing-assembly circuits 50.

Control-system communication lines 51 connect the bearing-control manifold 40 to a turret position controller 52.

Other segmental bearing-control manifolds 53 are connected similarly to the main hydraulic power unit 34, to the emergency hydraulic power unit 35, to the hydraulic reservoir 36 and to the stored-energy accumulator 37 with the first hydraulic line 41, the second hydraulic line 42 and the return line 47. Also, the other segmental bearing-control manifolds 53 are in control communication with the turret position controller 52 through the control-system communication lines 51.

Figure 6:
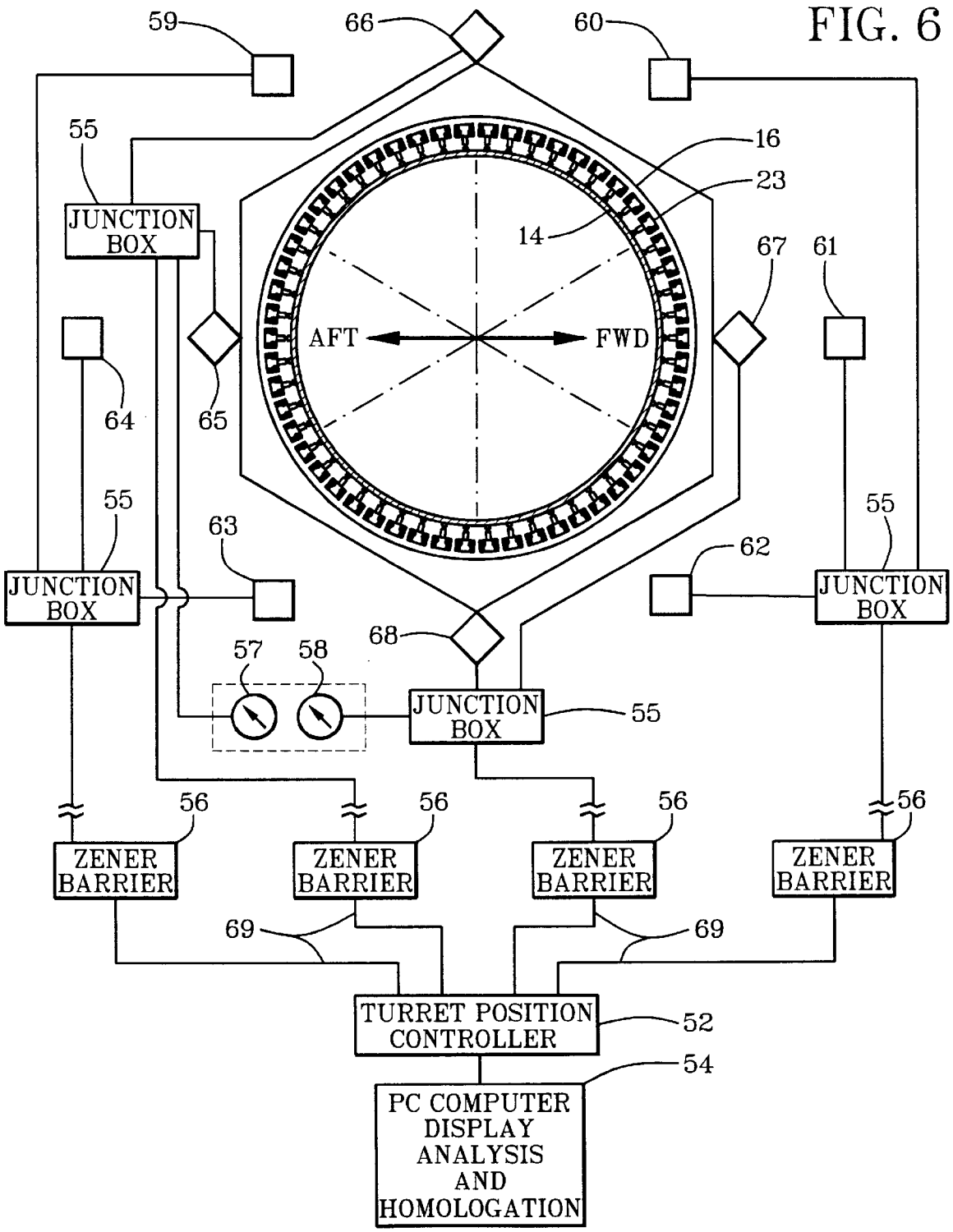
FIG. 6 is a block diagram of an electrical control system for the circumferential arrangement of fifty-four bearing assemblies.

Referring to FIG. 6 and referring further to FIGS. 1–5 also, the turret position controller 52 has a PC homologated computer 54 (not described in this document) that is structured and programmed to analyze physical dimensions resulting from turret movement and turret distortional factors. The PC homologated computer 54 is structured and programmed further to direct turret positioning to the turret position controller 52 for actuating the horizontal bearings 10, the vertical bearings 11 and the turret rotator 9 for homologated compensative control of verticality attitude and directional rotation of the turret cylinder 7 for universal stabilization of the universally stable mooring turret 1. Display analysis and homologation by the PC homologated computer 54 are provided for the turret position controller 52.

Position sensors such as horizontal-position transducers and verticality transducers transmit horizontal-position data and verticality data respectively to the turret position controller 52 and to the PC homologated computer 54 through junction boxes 55 and zener barriers 56 with intrinsic safety to allow the sensors to operate safely in hazardous areas. Local horizontal indicators 57 and local vertical indicators 58 provide visual indication of turret-cylinder 7 positioning in relation to positioning of the oil-well ship 6. Horizontal-position transducers include at least a port-aft horizontal transducer 59, a port-forward horizontal transducer 60, a forward horizontal transducer 61, a starboard-forward horizontal transducer 62, a starboard-aft horizontal transducer 63 and an aft horizontal transducer 64. Verticality transducers include at least an aft verticality transducer 65, a port verticality transducer 66, a forward verticality transducer 67 and a starboard verticality transducer 68. Control-system lines 69 are common throughout the entire control system.

Aspects of technology and structure of components such as bearing materials, sensors, transducers, valves, gages manifolds, zener barriers and computers not within the scope of this invention are not necessarily included in this document.

Figure 7:
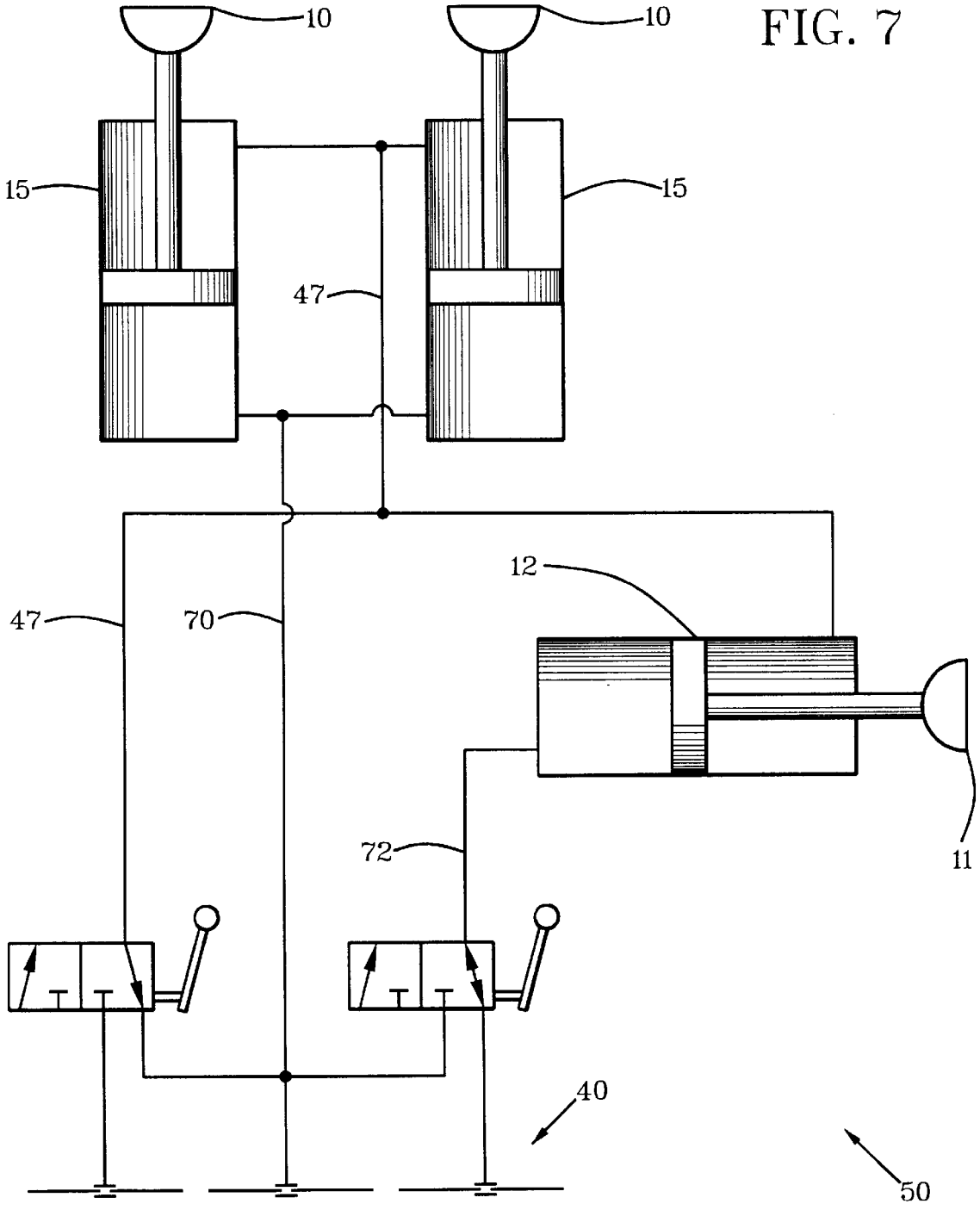
FIG. 7 is schematic representation of a hydraulic circuit for a bearing assembly.

Referring to FIG. 7 and referring further to FIG. 5, bearing-assembly circuits 50 have vertical-pressure lines 70 in fluid communication intermediate vertical-cylinder input valves 71 shown in FIG. 5 and a segment bearing-control manifold 40. The bearing-assembly circuits 50 also have horizontal-pressure lines 72 in fluid communication intermediate horizontal-cylinder input valves 73 shown in FIG. 5 and the segment bearing-control manifold 40. Return lines 47 from return valves 48 shown in FIG. 5 are common to all bearing-assembly circuits 50.

Referring to FIG. 8, the turret position controller 52 has a control panel 74 with the PC homologated computer 54 having a visual display unit 75 for analyzing, computing, displaying, homologating and communicating control factors for the universally stable mooring turret 1 A turret turn-lock-system computer unit 76 is in control communication intermediate the PC homologated computer 54 and turret turn-lock-system equipment 77 which rotates the turret cylinder 7 and receives rotational position data from the turret cylinder 7. The turret rotator 9 described in relation to FIG. 1 is a basic element of the turret turn-lock-system equipment 77.

A turret position monitoring system 78 has a horizontal monitor 79 and a vertical monitor 80 in communication intermediate the turret cylinder 7, and, respectively, the local horizontal indicator 57 and the local vertical indicator 58. The horizontal transducers 59–64 and the verticality transducers 65–68 described in relation to FIG. 6 are sensors included in the horizontal monitor 79 and the vertical monitor 80. The turret position controller 52 is in twoway communication with the horizontal monitor 79 and the vertical monitor 80 through the control panel 74, the PC homologated computer 54 and the visual display unit 75 for computing, analyzing and homologating control factors. The control panel 74 is in control communication with the bearing-control manifold 40 through which control is provided to bearing assemblies 23 having horizontal bearings 10 and vertical bearings 11, described in relation to FIGS. 1–7.

A manual override 81 is in direct communication with the bearing-control manifolds 40. Local computer-generated indicators 82 are in control communication with the control panel 74 for aiding control analysis. A turret-bearing lubrication system 83 is operated by a lubrication controller 84 that receives computerized control direction from the control panel 74 for lubricating horizontal bearings 10 and vertical bearings 11 with bearing lubricators 25 described in relation to FIGS. 1–3.

A turret turn-lock-system control panel 85 separate from the control panel 74 is in twoway communication with the turret turn-lock-system computer unit 76 which is in twoway communication with the PC computer 54 for individual control and emergency control as necessary.

Control elements requiring human attention are positioned within a safe area indicated schematically by a dashed line.

The turret turn-lock system equipment 77 and the turret bearing control system 86 are controlled through the turret position controller 52 with duplicative redundancy, computerized control and optional manual override from a non-hazardous position as described in relation to this block diagram of the control system.

Figure 9:
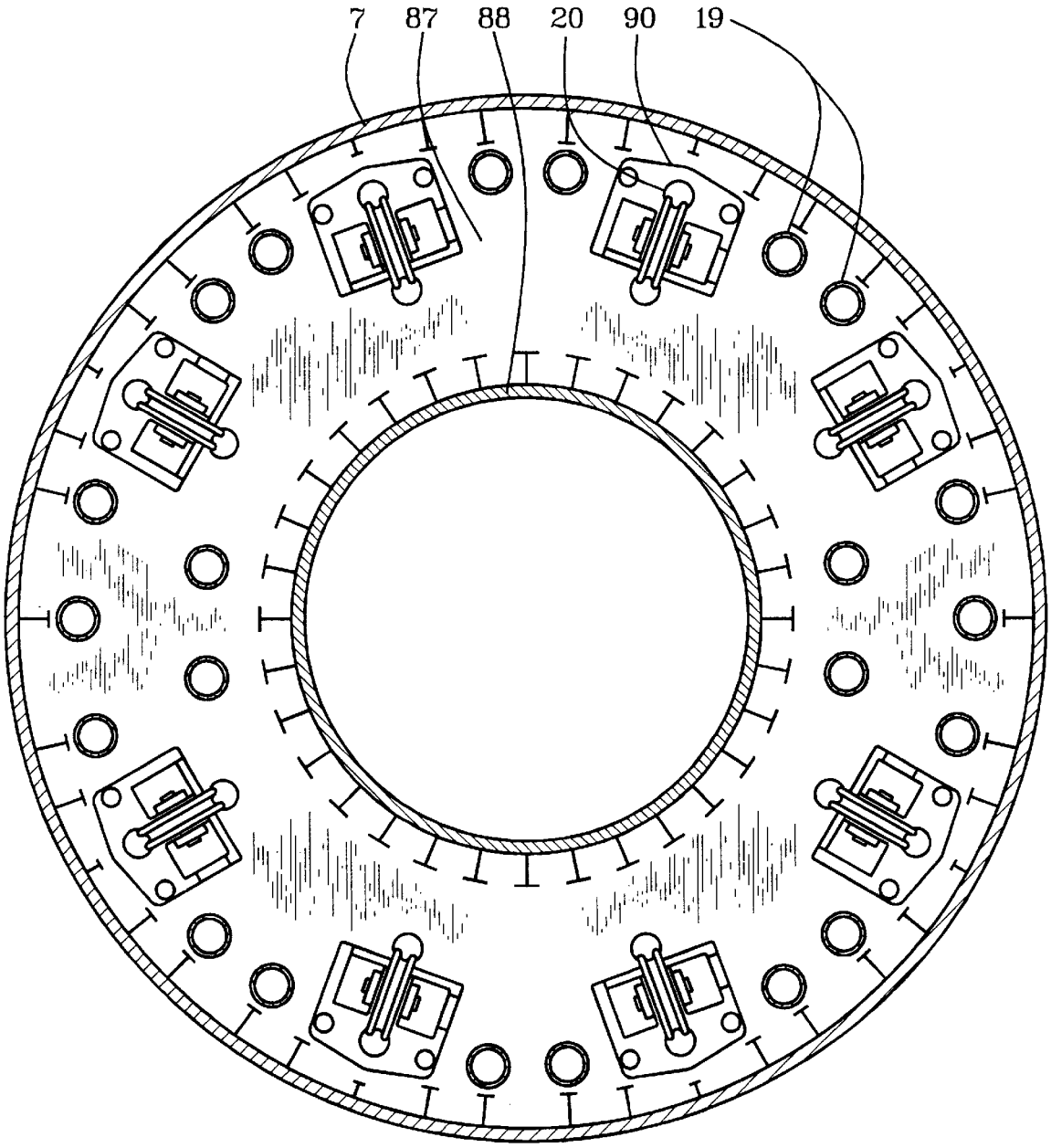
FIG. 9 is a top view of a general arrangement of a turret winch deck.

Referring to FIG. 9 and referring further to FIG. 1, a turret winch deck 87 can be positioned below a main deck 4 with greater safety from hazardous conditions by positioning a moonpool cylinder 88 linearly within the turret cylinder 7. The moonpool cylinder 88 can be attached to a deck proximate the turret flange 8. A turret cylinder 7 with a central moonpool cylinder 88 can be made structurally synonymous to a double-walled turret cylinder 7 with high structural integrity in addition to providing an internal wall to prevent items and workers from falling into the ocean. One or more structural plates 89 can be positioned at a low level between the inside periphery of the turret cylinder 7 and an outside periphery of the moonpool cylinder 88 as shown in FIG. 1 to further enhance structural integrity.

A plurality of chain winches 90 are positioned on the turret winch deck 87 in working proximity to chain pipes 20. As depicted in FIG. 1, riser tubes 19 are extended from a riser-connection deck 91 proximate the turret flange 8 to proximate the bottom 5 of the oil-well ship 6 and pass through the turret winch deck 87.

The plurality of chain pipes 20 and riser tubes 19 arranged circumferentially as shown from a top view depict possible pluralities and arrays of marine risers 21 and anchor chains 22 that require prevention of directional change of the turret cylinder 7 and the turret winch deck 87. As depicted in FIG. 1, an annular operational space 92 intermediate an outside periphery of the moonpool cylinder 88 and an inside periphery of the turret cylinder 7 is sized, shaped and structured to receive pluralities of anchoring suspensions such as the chain pipes 20 and pluralities of petroleum-equipment suspensions such as the riser tubes 19.

In addition to safety and structural integrity, the moonpool cylinder 88 provides a means for communication with a body of water and a seabed separately from communication through the riser tubes 19 and the chain pipes 20.

Figure 10:
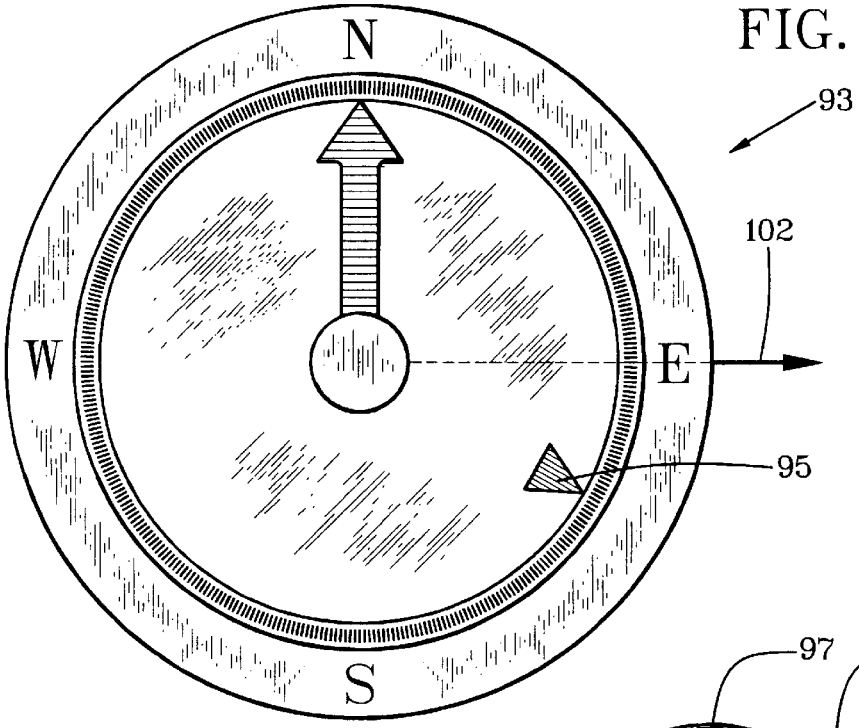
FIG. 10 is a top view of a direction transducer.
Figure 11:
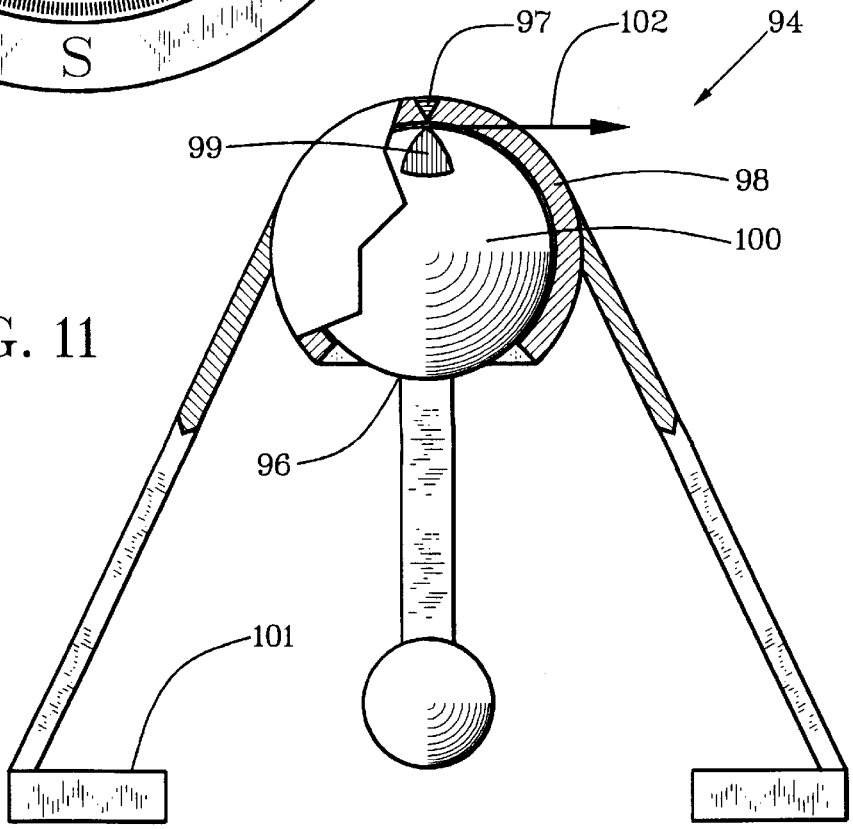
FIG. 11 is a partially cutaway elevation view of a verticality transducer.

Referring to FIGS. 10–11, the turret position controller 52, described in relation to FIGS. 5 and 8, is a universal position controller when referenced to and in electronic communication with a direction transducer 93 shown in FIG. 10 and a verticality transducer 94 shown in FIG. 11. The direction transducer 93 can be a compass with electronic readout from a base reference point 95 that indicates a direction from which the turret cylinder 7, described in relation to FIG. 1, is prevented from deviating by compensative counter rotation with the turret rotator 9, described in relation to FIG. 1. The verticality transducer 94 can be a ball-and-socket pendulum 96 with electronic readout of variance of an attitudinal point 97 on the socket 98 from a verticality point 99 on a ball 100 of the ball-and-socket pendulum 96. A verticality-transducer base 101 can be attached to a normally horizontal portion of the oil-well ship 6. Communication lines 102 from the direction transducer 93 and the verticality transducer 94 to the turret position controller 52 which becomes a universal position controller can be electrical or radio wave.

Other types of direction transducers 93 and verticality transducers 94 are foreseeable and intended. These merely demonstrate a general nature of such items that can be employed.

A new and useful universally stable oil-well-ship turret having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A universally stable mooring turret comprising:

a circumturret cylinder extended vertically downward from a turret base proximate a main deck of an oil-well ship to a bottom of a well-working portion of the oil-well ship;

a turret cylinder extended rotationally downward inside of the circumturret cylinder and having a turret flange extended radially outward above the turret base;

a turret rotator in rotative communication between the circumturret cylinder and the turret cylinder;

the turret rotator being actuated to rotate the turret cylinder in compensating opposition to directional change of the circumturret cylinder resulting from directional change of the oil-well ship;

a plurality of horizontal bearings which are extended horizontally from horizontal-bearing pressure cylinders that are attached to bearing bases that are affixed circumferentially to the oil-well ship about an outside periphery of the turret base;

a horizontal-bearing race that is oriented vertically on a circumferential portion of the turret flange;

the plurality of horizontal bearings being actuated by the horizontal-bearing pressure cylinders to bear against the horizontal-bearing race selectively in response to a horizontal-pressure controller;

a plurality of vertical bearings that are extended vertically from vertical-bearing pressure cylinders that are attached to bearing bases that are affixed circumferentially to the oil-well ship about the outside periphery of the turret base;

a vertical-bearing race that is oriented horizontally on a bottom circumferential portion of the turret flange;

the plurality of vertical bearings being actuated by the vertical-bearing pressure cylinders to bear against the vertical-bearing race selectively in response to a vertical-pressure controller;

the horizontal-pressure controller and the vertical-pressure controller being coordinated and controlled by a turret position controller positioned in a control position from which control of the mooring turret is communicated on the oil-well ship;

an annular-clearance space intermediate an inside periphery of the circumturret cylinder and an outside periphery of the turret cylinder;

the annular-clearance space being sized and shaped for containing the turret cylinder upright vertically while the circumturret cylinder is being tilted randomly from turning, heaving, yawing and moving of the oil-well ship by wave and weather and conditions;

the turret cylinder inside of the randomly tilting and turning circumturret cylinder being positioned horizontally by the plurality of horizontal bearings and being positioned vertically by the plurality of vertical bearings in coordinated response to the horizontal-pressure controller and the vertical-pressure controller respectively; and the turret cylinder being rotatable on the plurality of vertical bearings and being rotatable horizontally intermediate contact surfaces of the plurality of horizontal bearings that are oppositely disposed circumferentially with coordinated bearing control being applied in compensating opposition to vertical and horizontal displacement pressures and in compensating opposition to rotational pressures resulting from wave, weather, ocean-current and ship-steering factors in order to maintain operable concentricity of the turret cylinder in relationship to the circumturret cylinder, in order to maintain operably horizontal and orthogonally vertical attitude of turret-based equipment and in order to compensate for side pressures of mooring lines, risers and other operating equipment suspended from the mooring turret.

2. A universally stable mooring turret as described in claim 1 wherein:

the horizontal bearings have size, shape, bearing capacity and plurality to position the turret cylinder horizontally in compensating opposition to horizontal displacement of the circumturret cylinder from horizontal displacement of the oil-well ship.

3. A universally stable mooring turret as described in claim 1 wherein:

the horizontal bearings have size, shape, bearing capacity and plurality to position the turret cylinder horizontally in compensating opposition to asymmetrically horizontal distortion of items of support of the horizontal bearings and in compensating opposition to asymmetrically horizontal distortion of the horizontal-bearing race from ambient conditions; and the items of support of the horizontal bearings include the main deck and the turret base on the oil-well ship.

4. A universally stable mooring turret as described in claim 3 wherein:

the horizontal bearings have size, shape, bearing capacity and plurality to position the turret cylinder horizontally in compensating opposition to horizontal displacement of the circumturret cylinder from horizontal displacement of the oil-well ship.

5. A universally stable mooring turret as described in claim 1 wherein:

the vertical bearings have size, shape, bearing capacity and plurality to position the turret cylinder vertically in compensating opposition to verticality of the circumturret cylinder resulting from random vertical orientation of the oil-well ship.

6. A universally stable mooring turret as described in claim 1 wherein:

the vertical bearings have size, shape, bearing capacity and plurality to position the turret cylinder vertically in compensating opposition to asymmetrically vertical distortion of the main deck and the turret base which are items of support of the vertical bearings and in compensating opposition to asymmetrically vertical distortion of the vertical-bearing race from affects of ambient conditions on the oil-well ship.

7. A universally stable mooring turret as described in claim 6 wherein:

the vertical bearings have size, shape, bearing capacity and plurality to position the turret cylinder vertically in compensating opposition to verticality of the circumturret cylinder resulting from random vertical orientation of the oil-well ship.

8. A universally stable mooring turret as described in claim 1 wherein:

the horizontal bearings have frictional bearing surfaces.

9. A universally stable mooring turret as described in claim 8 wherein:

pressure of the horizontal bearings actuated by the horizontal-bearing pressure cylinders against the horizontal-bearing race in response to the horizontal-pressure controller is variable selectively between negative pressure to allow freely sliding contact of the horizontal-bearing race with the horizontal bearings and selectively high positive pressure to prevent rotation of the horizontal-bearing race and the turret cylinder to which the horizontal-bearing race is attached.

10. A universally stable mooring turret as described in claim 1 wherein:

the vertical bearings have frictional bearing surfaces.

11. A universally stable mooring turret as described in claim 1 wherein:

the horizontal bearings and the vertical bearings have lubricators that are remotely controllable.

12. A universally stable mooring turret as described in claim 1 wherein:

the plurality of horizontal bearings are positioned in controllable groups circumferentially about the turret base.

13. A universally stable mooring turret as described in claim 1 wherein:

the plurality of vertical bearings are positioned in controllable groups circumferentially about the turret base.

14. A universally stable mooring turret as described in claim 1 wherein:

the plurality of horizontal bearings is 54.

15. A universally stable mooring turret as described in claim 1 wherein:

the plurality of vertical bearings is 108.

16. A universally stable mooring turret as described in claim 1 wherein:

the plurality of vertical bearing is double the plurality of horizontal bearings.

17. A universally stable mooring turret as described in claim 1 wherein:

the horizontal bearings and the vertical bearings are assembled in a plurality of assemblies of two vertical bearings and one horizontal bearing.

18. A universally stable mooring turret as described in claim 17 wherein:

the plurality of assemblies of two vertical bearings and one horizontal bearing is 54.

19. A universally stable mooring turret as described in claim 18 wherein:

the plurality of 54 assemblies of two vertical bearings and one horizontal bearing are grouped arcuately into six control segments of nine assemblies of two vertical bearings and one horizontal bearing.

20. A universally stable mooring turret as described in claim 19 wherein:

the six control segments of nine assemblies of two vertical bearings and one horizontal bearing are designated a first control segment, a second control segment, a third control segment, a fourth control segment, a fifth control segment and a sixth control segment; and the first control segment is a port-aft segment, the second control segment is a port-forward segment, the third control segment is a forward segment, the fourth control segment is a starboard-forward segment, the fifth control segment is a starboard-aft segment and the sixth control segment is an aft segment.

21. A universally stable mooring turret as described in claim 1 wherein:

the turret position controller has a PC homologated computer;

the PC homologated computer is structured and programmed to analyze predetermined physical dimensions of the horizontal-bearing race and the vertical-bearing race resulting from turret movement and distortional factors; and the PC homologated computer is structured and programmed to direct turret positioning to the turret position controller in accordance with predetermined turret-positioning criteria.

22. A universally stable mooring turret as described in claim 21 wherein:

the turret position controller has a computerized visual display unit that is structured and programmed to display the predetermined physical dimensions to the turret-position controller and to the PC homologated computer.

23. A universally stable mooring turret as described in claim 22 wherein:

the PC homologated computer is structured and programmed to be reprogrammed and adjusted for communication of control factors to the turret position controller.

24. A universally stable mooring turret as described in claim 22 wherein:

position sensors and pressure transducers are positioned in proximity to such positional and supportive items as the horizontal bearings, the vertical bearings, the horizontal-bearing race, the vertical-bearing race and the turret bearing race for communicating turret-position information to the turret position controller and to the PC homologated computer.

25. A universally stable mooring turret as described in claim 24 wherein:

electrical circuits having zener barriers for intrinsic safety and certification thereof are structured and positioned to communicate turret-position information from the position sensors and pressure transducers to the turret position controller and to the PC homologated computer selectively.

26. A universally stable mooring turret as described in claim 1 wherein:

the turret cylinder has a moonpool cylinder positioned concentrically inside of the turret cylinder;

the moonpool cylinder is attached rigidly to the turret cylinder;

circumferentially intermediate an outside circumferential periphery of the moonpool cylinder and an inside periphery of the turret cylinder is an annular operational space; and the annular operational space is sized, shaped and structured to receive pluralities of anchoring suspensions and pluralities of petroleum-equipment suspensions.

27. A universally stable mooring turret comprising:

a circumturret cylinder extended vertically downward from a turret base proximate a main deck to a bottom of a well-working portion of an oil-well ship;

a turret cylinder extended rotationally downward inside of the circumturret cylinder and having a turret flange extended radially outward above the turret base;

a universal bearing system intermediate the turret base and the turret flange;

the turret cylinder being controllably pivotal universally and suspended rotationally on the universal bearing system;

a turret position controller intermediate the turret base and the turret cylinder;

an annular-clearance space intermediate an inside periphery of the circumturret cylinder and an outside periphery of the turret cylinder; and the annular-clearance space being sized and shaped for maintaining selectively upright verticality of the turret cylinder in side of the circumturret cylinder while the circumturret is being tilted randomly from tossing, turning, heaving, yawing and moving of the oil-well ship by wave and weather conditions.

28. A universally stable mooring turret as described in claim 27 wherein:

the universal position controller has a turret rotator in rotation-imparting communication between the turret base and the turret cylinder; and the turret rotator is actuated by the turret position controller to rotate the turret cylinder in compensating opposition to directional change of the oil-well ship and the circumturret cylinder which is affixed to the oil-well ship.

29. A universally stable mooring turret as described in claim 27 wherein:

the turret position controller is a universal position controller having a verticality controller in universally pivot-imparting communication between the turret base and the turret cylinder;

the verticality controller is actuated by the universal position controller to pivot the turret cylinder universally to select verticality in compensating opposition to verticality change of the circumturret cylinder which is affixed to the oil-well ship.

30. A universally stable mooring turret as described in claim 29 wherein:

the universal position controller is referenced to and in electronic communication with a verticality transducer and with a direction transducer;

the verticality transducer is structured to measure variation of the circumturret cylinder from true verticality and to communicate required attitudinal alteration of the turret cylinder to the universal position controller for maintaining true verticality of the turret cylinder to compensate for variation of the circumturret cylinder from true verticality;

the direction transducer is structured to measure variation of the circumturret cylinder from a base reference direction and to communicate required horizontal-plane rotation of the turret cylinder to the universal position controller for maintaining a base reference direction of the turret cylinder in relation to desired array of lines such as marine risers and ship-mooring lines attached to the turret cylinder.

31. A universally stable mooring turret as described in claim 30 wherein:

the turret position controller has a PC homologated computer;

the PC homologated computer is structured and programmed to analyze physical dimensions, distortions and positions of select components of the mooring turret resulting from affects of ambient conditions on the oil-well ship; and the PC homologated computer is structured and programmed to direct turret positioning to the turret position controller in accordance with predetermined criteria in relationship to physical dimensions, distortions and positions of the select components of the mooring turret.

32. A universally stable oil-well-ship turret as described in claim 31 wherein:

the turret position controller has a computerized visual display unit that is structured and programmed to display physical aspects of information communicated to and from the turret position controller and to the PC homologated computer.

33. A universally stable mooring turret as described in claim 32 wherein:

the PC homologated computer is structured and programmed to be reprogrammed and adjusted for communication of control factors to the turret position controller.

34. A universally stable mooring turret as described in claim 32 wherein:

position sensors and pressure transducers are positioned in proximity to such positional and supportive items as the horizontal bearings, the vertical bearings, the horizontal-bearing race, the vertical-bearing race and the turret bearing race for communicating turret-position information to the turret position controller and to the PC homologated computer.

35. A universally stable mooring turret as described in claim 34 wherein:

electrical circuits having zener barriers for intrinsic safety and certification thereof are structured and positioned to communicate turret-position information from the position sensors and pressure transducers to the turret position controller and to the PC homologated computer selectively.

36. A universally stable mooring turret as described in claim 27 wherein:

the turret cylinder has a moonpool cylinder positioned concentrically inside of the turret cylinder;

the-moonpool cylinder is attached rigidly to the turret cylinder;

circumferentially intermediate an outside circumferential periphery of the moonpool cylinder and an inside periphery of the turret cylinder is an annular operational space; and the annular operational space is sized, shaped and structured to receive pluralities of anchoring suspensions and pluralities of petroleum-equipment suspensions.

37. A method comprising the following steps for universally stabilizing a mooring turret of an oil-well ship:

providing an oil-well ship having a circumturret cylinder extended vertically downward from a turret base proximate a main deck to a bottom of an well-working portion of the oil-well ship;

positioning a turret cylinder rotationally inside of the circumturret cylinder with an annular-clearance space intermediate an inside periphery of the circumturret cylinder and an outside periphery of the turret cylinder;

the turret cylinder having a turret flange extended radially outward above the turret base;

providing a bearing system having pivotal support of the turret cylinder in a plurality of pivotal directions universally within the circumturret cylinder;

positioning the bearing system on the turret base with universally pivotal contact of the turret flange with the turret base for selectively universal pivoting of the turret cylinder within the annular-clearance space; and positioning a universal position controller in selectively universal position control of attitude and rotation of the turret cylinder in selectively compensating opposition to changes of attitude and directional positioning of the circumturret cylinder resulting from attitudinal and directional changes of the oil-well ship, such that the turret cylinder can be maintained universally stable in attitude and direction while the oil-well ship changes attitude and direction.

38. A method as described in claim 37 and further comprising:

measuring variation of verticality of the circumturret cylinder from true verticality with a verticality transducer;

measuring variation of direction of the circumturret cylinder from a base direction with a direction transducer; and referencing the universal position controller to and in electronic communication with the verticality transducer and with the direction transducer.

39. A method as described in claim 38 and further comprising:

providing the turret position controller with a PC homologated computer having a visual display unit;

the PC homologated computer being structured and programmed to computer-analyze information communicated to the turret position controller for determining variations of physical structure, physical position and directional position of such mooring-turret components as the turret cylinder, a universal turret-cylinder bearing system, a vertical-bearing race and a horizontal-bearing race.

40. A method as described in claim 39 and further comprising:

programming the PC homologated computer to modify predetermined criteria of the turret position controller in accordance with empirical data obtained from the turret position controller in relation to effectiveness of direction of the turret position controller in maintaining universal stability of the mooring turret.

41. A method as described in claim 40 and further comprising:

programming the PC homologated computer to provide anticipative control direction to the turret position controller in accordance with empirical data communicated previously from the turret position controller to the PC homologated computer.

42. A method as described in claim 39 and further comprising:

programming the PC homologated computer to provide control direction to the turret position controller simultaneously with directional requirements for universal positioning and control of universal positioning of the turret cylinder in compensating opposition to attitudinal change and directional change of the circumturret cylinder from effects of ambient conditions on the oil-well ship, such that the simultaneous control direction mirrors effects of ambient conditions instead of reacting to effects of the ambient conditions after their occurrence.

43. A method as described in claim 42 wherein:

mirroring effects of ambient conditions on the oil-well ship which affect components of a mooring turret on the oil-well ship are generated by the PC homologated computer with mathematical models which describe effects of the ambient conditions on the components of the mooring turret as a result of effects of the ambient conditions on the oil-well ship and which mirror control direction to the turret position controller for simultaneously compensatory communication to actuators of the bearing system having pivotal support of the turret cylinder in a plurality of pivotal directions universally.

44. A method as described in claim 43 wherein:

mathematical models generated by the PC homologated computer are modified as desired for particular intellectualization and self-checking for reliability of control direction to the turret position controller.

* * * * *